US010704313B2

(12) United States Patent
Houser et al.

(10) Patent No.: US 10,704,313 B2
(45) Date of Patent: Jul. 7, 2020

(54) DOOR CLOSER

(71) Applicant: Yale Security, Inc., Monroe, NC (US)

(72) Inventors: Blue Houser, Edgemoor, SC (US); Dustin E. Lawhon, Lilesville, NC (US); Peter E. Zasowski, Yantis, TX (US)

(73) Assignee: Assa Abloy Accessories And Door Controls Group, Inc., New Haven, CT (US)

( * ) Notice: Subject to any disclaimer, the term of this patent is extended or adjusted under 35 U.S.C. 154(b) by 129 days.

(21) Appl. No.: 15/856,276

(22) Filed: Dec. 28, 2017

(65) Prior Publication Data

US 2018/0148970 A1 May 31, 2018

Related U.S. Application Data

(63) Continuation of application No. 14/774,913, filed as application No. PCT/US2014/028190 on Mar. 14, 2014, now Pat. No. 9,869,117.

(Continued)

(51) Int. Cl.
*E05F 15/611* (2015.01)
*E05F 15/70* (2015.01)

(Continued)

(52) U.S. Cl.
CPC ..... *E05F 15/611* (2015.01); *E05F 15/60* (2015.01); *E05F 15/63* (2015.01); *E05F 15/79* (2015.01); *E05F 1/105* (2013.01); *E05F 15/70* (2015.01); *E05Y 2201/412* (2013.01); *E05Y 2400/302* (2013.01); *E05Y 2400/514* (2013.01); *E05Y 2400/564* (2013.01); *E05Y 2400/612* (2013.01); *E05Y 2400/614* (2013.01); *E05Y 2400/616* (2013.01); *E05Y 2800/113* (2013.01); *E05Y 2900/132* (2013.01)

(58) Field of Classification Search
CPC ..... E05F 15/63; E05F 15/611; E05F 15/70; E05F 1/105; Y10T 16/27; Y10T 16/293; E05Y 2900/132; E05Y 2400/302; E05Y 2400/612; E05Y 2400/36; E05Y 2201/25; E05Y 2201/21; E05Y 2201/434; E05Y 2201/41

See application file for complete search history.

(56) References Cited

U.S. PATENT DOCUMENTS 2,843,376 A 7/1958 Osuch et al.
4,973,894 A 11/1990 Johansson (Continued)

*Primary Examiner* — Justin B Rephann
(74) *Attorney, Agent, or Firm* — DeLio Peterson & Curcio LLC; Peter W. Peterson

(57) ABSTRACT

A door closer with an electric motor-assisted closing feature, that may generate its own power to assist in closing, and controls the speed of opening and closing of the door during generation is disclosed. Embodiments of the present disclosure are realized by a motorized door closer that electrically creates a latch boost force for a closing door. The door closer includes a motor disposed to operatively connect to a door so that the door will be moved toward closed when the motor moves, and a position sensor to determine a position of the door. A processor is programmed to exert a closing force on the door in the latch boost region or when it otherwise detects that a motor assist is needed.

41 Claims, 13 Drawing Sheets

Related U.S. Application Data

(60) Provisional application No. 61/785,207, filed on Mar. 14, 2013.

(51) Int. Cl.

| | |
|---|---|
| ***E05F 15/60*** | (2015.01) |
| ***E05F 15/63*** | (2015.01) |
| ***E05F 15/79*** | (2015.01) |
| *E05F 1/10* | (2006.01) |

(56) References Cited

U.S. PATENT DOCUMENTS

| | | | | |
|---|---|---|---|---|
| 5,193,647 | A | 3/1993 | O'Brien, II | |
| 5,243,735 | A | 9/1993 | O'Brien, II | |
| 5,386,885 | A | 2/1995 | Bunzl et al. | |
| 5,789,887 | A | 8/1998 | Elischewski | |
| 5,878,530 | A | 3/1999 | Eccleston et al. | |
| 6,061,964 | A | 5/2000 | Arnell et al. | |
| 6,316,892 | B1 | 11/2001 | Valencia | |
| 6,633,094 | B1 | 10/2003 | Andou | |
| 6,640,494 | B2 | 11/2003 | Hormann | |
| 6,883,275 | B2 | 4/2005 | Hellinga et al. | |
| 7,555,867 | B2 | 7/2009 | Liles, Jr. | |
| 8,169,169 | B2 | 5/2012 | Hass et al. | |
| 8,225,458 | B1 | 7/2012 | Hoffberg | |
| 8,564,235 | B2 | 10/2013 | Burris et al. | |
| 8,773,237 | B2 | 7/2014 | Burris et al. | |
| 8,779,713 | B2 | 7/2014 | Burris et al. | |
| 8,844,200 | B2 * | 9/2014 | Yulkowski | E05F 15/50 49/138 |
| 9,052,184 | B2 | 6/2015 | Gutzmer et al. | |
| 2006/0197481 | A1 | 9/2006 | Hotto et al. | |
| 2006/0244271 | A1 * | 11/2006 | Hass | E05F 15/70 292/336.3 |
| 2009/0093913 | A1 | 4/2009 | Copeland, II et al. | |
| 2009/0265992 | A1 * | 10/2009 | Hass | E05F 15/63 49/340 |
| 2010/0115853 | A1 | 5/2010 | Gebhart et al. | |
| 2010/0242368 | A1 | 9/2010 | Yulkowski | |
| 2011/0225889 | A1 | 9/2011 | Sohn et al. | |
| 2011/0257797 | A1 * | 10/2011 | Burris | E05F 3/102 700/282 |
| 2011/0279098 | A1 | 11/2011 | Ren et al. | |
| 2012/0029701 | A1 | 2/2012 | Houser | |
| 2013/0340343 | A1 * | 12/2013 | Dye | E05F 15/614 49/70 |
| 2014/0346997 | A1 | 11/2014 | Salutzki et al. | |

* cited by examiner

DOOR CLOSER

BACKGROUND OF THE INVENTION

1. Field of the Invention

Aspects of the present disclosure may relate to door closers for automatic closing of doors, and in particular may relate to door closers with a latch boost feature and that may be regenerative.

2. Description of Related Art

Door closers are used to automatically close doors, hold doors open for short intervals, and control opening/closing speeds in order to facilitate passage through a doorway and to help ensure that doors are not inadvertently left open. A door closer is often attached to the top or bottom of a door, and when the door is opened and released, the door closer generates a mechanical force that causes the door to automatically close without any user input. Thus, a user may open a door and pass through its doorway without manually closing the door.

Many conventional door closers are designed such that when opened a spring is compressed and energy is stored in the spring. When the door is allowed to close the energy stored in the spring is used to return the door to the closed position. Many different arm configurations exist for creating a desired force curve in the opened and closed direction. However all configurations have less force available in the closing direction than was required to open the door due to mechanical losses of the system. Additionally most configurations have the same shape curve in the opening and closing direction. Because, more force is desired in the latch region during close to overcome the latching hardware, most configurations require significant force to begin opening the door. Additionally the force must be set high enough to close the door under adverse conditions, such as stack pressure, leading to even higher forces required to open the door at times when the adverse conditions are not present.

Many conventional door closers are mechanically actuated and have a plurality of valves and springs for controlling the varying amounts of force applied to the door as a function of door angle and/or speed, as described above. A typical door closer may also have a piston that moves through a reservoir filled with a hydraulic fluid, such as oil. Adjusting the valve settings in such a conventional door closer can be difficult and problematic since closing times can vary because of the systems dependency on temperature, pressure, wear, and installation configuration. Moreover, adjusting the valve settings in order to achieve a desired closing profile for a door can be burdensome for at least some users. Many door closers exhibit much less than ideal closing characteristics because users are either unwilling or unable to adjust and re-adjust the valve settings in a desired manner or are unaware that the settings can and may need to be changed in order to effectuate a desired closing profile in the face of temperature changes, wear over time, and/or modifications to the physical installation.

SUMMARY OF THE INVENTION

Bearing in mind the problems and deficiencies of the prior art, it is therefore an object of the present invention to provide an apparatus and method for determining angle of door opening and applying force to resist and slow the door as it approaches and/or passes a predetermined angle of opening.

It is another object of the present invention to provide an apparatus and method for determining when an assist is needed to complete closing of the door, and thereafter applying force to assist the door in closing to the closed position.

A further object of the invention is to provide an apparatus and method for determining when an assist is needed to complete closing of the door by door position, speed and/or time of closing.

It is yet another object of the present invention to provide an apparatus and method for applying force to assist the door in closing to the closed position from energy generated and stored exclusively by the motion of the door, without the use of any external power source.

It is a further object of the present invention to provide an apparatus and method for applying more force to the door to assist in closing than was generated by opening the door.

Still other objects and advantages of the invention will in part be obvious and will in part be apparent from the specification.

Embodiments of a door closer disclosed herein may be realized by a motorized door closer that may electrically create a "latch boost" for causing a door to latch. The latch boost in such embodiments may be created by electrical control of the motor. The door closer in some embodiments may be self-powered by causing the motor to act as a generator to charge a battery or capacitor, and self-adjusting through control of the motor with known motor control means.

The above and other objects, which will be apparent to those skilled in the art, are achieved in the present invention which is directed to a door closer comprising an electric motor configured to be operatively connected to a door, wherein the drive shaft of the electric motor rotates when the door moves in the direction of closing, and the door moves in the direction of closing in response to the rotation of the drive shaft of the electric motor. The door closer includes a position sensor for determining the position of the door and a controller to control the electric motor including a processor configured to receive input from the position sensor. When the position sensor indicates that the door is in a latch boost region or the controller otherwise determines that a motor assist is needed, the controller causes the electric motor to be powered to apply force to assist the door in closing.

The door closer may include a spring adapted to bias the door toward the closed position. When the door moves in the direction of closing and the electric motor is not powered, the electric motor acts as a generator and generated power is stored in an energy storage element. When the door moves in the direction of opening, the electric motor is not powered, and the electric motor acts as a generator and generated power is stored in the energy storage element.

The door position sensor may be a potentiometer or rotary encoder, and the processor may receive input from the potentiometer or rotary encoder for determining the door position and the closing speed of the door. The position sensor may operate by sensing proximity of a magnet or may comprise a Hall effect device.

The door closer may include a potentiometer that controls electrical resistance across the motor/generator or other means for varying input and/or output power to/from the motor/generator to control the rotation of the electric motor and slow/quicken the closing speed of the door. The processor may be programmed to control the potentiometer or other means of control to automatically adjust the closing speed of the door.

The door closer may include a memory, wherein the processor is operatively connected to the electric motor, the position sensor, and the memory, wherein the processor determines that the door is within the latch boost region or otherwise detects that a motor assist is needed and control the electric motor to exert a closing force on the door. The control of the electric motor to exert a closing force on the door may be accomplished by injecting or applying a voltage into the motor, or using other motor control methods.

In another aspect the present invention is directed to a method of operating a door closer using a controller and an electric motor. The method comprises determining that a door to which the door closer is attached is attempting to close through a latch boost region or that the door to which the door closer is attached is attempting to close is encountering conditions appropriate for motor assistance; and using the controller to cause the door closer, through electronic control of the electric motor, to exert a force to assist the closing of the door until the door closes.

The electronic control of the electric motor may comprise injecting or applying a voltage into the electric motor. The determining that the door is attempting to close through the latch boost region or that the door to which the door closer is attached is encountering conditions appropriate for motor assistance may comprise the controller receiving a position signal. The position signal can originate from a position sensor that may sense proximity indicating the door is in the latch boost region such as with a magnet and/or Hall effect sensor, or may sense angular position of the door as in a potentiometer and determine if conditions are appropriate for motor assistance. The controller may adjust the current through the motor/generator by controlling the resistance across the motor/generator or by controlling the current output of the motor/generator to vary the closing speed of the door based on input from the position sensor. The method may further comprise storing the generated power in an energy storage element.

In a further aspect the present invention provides a door closer comprising an electric motor/generator configured to be operatively connected to a door movable between a closed position and an open position. The electric motor/generator has a drive shaft which rotates when the door moves in the direction of opening and in the direction of closing. The motor/generator is configured to apply force to move the door in the direction of closing in response to the rotation of the drive shaft of the electric motor/generator. The door closer also includes a position sensor for determining the position of the door, including door position in the vicinity of the closed position, an electrical energy storage element connected to the motor/generator and configured to store electrical energy generated by the electric motor/generator as the door moves in the direction of opening or closing, and a motor/generator controller connected to the position sensor and motor/generator. The controller receives input from the position sensor and controlling operation of the electric motor/generator. The controller determines when a motor assist is needed to complete closing of the door, and thereafter causes the electric motor/generator to be powered by electrical energy generated by the electric motor/generator and stored in the electrical energy storage element to apply force to assist the door in closing to the closed position.

The position sensor may determine the position of the door at any position between the closed and open positions, or only in the vicinity of the closed position. The controller causes the electric motor/generator to apply force to assist the door in closing to the closed position based on the position sensor indicating that the door is in the vicinity of the closed position. The door closer may have a spring adapted to bias the door toward the closed position.

When the door moves in the direction of closing and the electric motor/generator is not powered, the electric motor/generator acts as a generator and generated power is stored in an energy storage element. When the door moves in the direction of opening, the electric motor/generator is not powered, and the electric motor/generator acts as a generator and generated power is stored in the energy storage element.

The door position sensor may be a potentiometer or a proximity switch. The proximity switch may indicate if the door is in the closed position. The position sensor may operate by sensing proximity of a magnet, or the position sensor may comprise a Hall effect device.

The door closer may include a potentiometer that controls electrical resistance to control the rotation of the electric motor/generator and slow the closing speed of the door. The motor/generator controller may include a processor programmed to control the potentiometer or other means for varying load on the motor/generator to automatically adjust the closing speed of the door. The door closer may include one or more motor control circuits operatively connected to the controller to permit the controller to control current in the motor/generator. The motor control circuits may include high and low gates in a half H-bridge configuration, or in a full H-bridge configuration.

The door closer may further include a memory operatively connected to the controller. The controller receives data from the memory to determine that a motor assist is needed and control the electric motor/generator to exert a closing force on the door.

The electric motor/generator may be powered exclusively by electrical energy generated by the electric motor/generator and stored in the electrical energy storage element. When the door moves in the direction of closing, the electric motor/generator may act as a brake on the rate of closing of the door. The control of the motor/generator to exert a closing force on the door may be accomplished by applying a voltage to the motor.

When a predetermined angle of door opening is reached, load on the motor/generator may be increased to resist opening further. The load on the motor/generator may be varied to resist the opening of the door to prevent the door from opening at an excessive rate. The door excessive rate may be defined as moving above a predetermined speed. The door closer may include a spring adapted to bias the door toward the closed position. The door excessive rate may consist of the door moving at a rate such that the kinetic energy of the door is greater than the energy that will be absorbed by the spring and losses as the door travels to a predetermined point.

In another aspect, the present invention provides a door closer comprising an electric motor/generator configured to be operatively connected to a door movable between a closed position and an open position. The electric motor/generator has a drive shaft that rotates when the door moves in the direction of opening and in the direction of closing. The motor/generator is configured to apply force to resist movement of the door in the opening and closing position. The door closer further includes a position sensor for determining the position of the door, an electrical energy storage element connected to the motor/generator and configured to store electrical energy generated by the electric motor/generator as the door moves in the direction of opening or closing, and a motor/generator controller connected to the position sensor and motor/generator. The controller receives input from the position sensor and controls operation of the electric motor/generator. The controller determines the load to apply to the motor/generator to control the speed of the door. The door closer is powered exclusively by electrical energy generated by the electric motor/generator and stored in the electrical energy storage element.

In a related aspect the invention is directed to a method of operating a door closer using an electric motor/generator operatively connected to a door movable between a closed position and an open position. The method comprises storing electrical energy generated by the electric motor/generator as the door moves in the direction of opening or closing, determining that a motor assist is needed to complete closing of the door, and causing the electric motor/generator to be powered by the stored electrical energy generated by the electric motor/generator to apply force to assist the door in closing to the closed position.

The method may further include determining the position of the door between the closed and open positions, and using the determined door position to determine that a motor assist is needed to complete closing of the door. The method may include determining the position of the door in the vicinity of the closed position, and using the determined door position to determine that a motor assist is needed to complete closing of the door. The method may include determining whether the door has not closed within a predetermined acceptable closing time, and using the determined door closing time to determine that a motor assist is needed to complete closing of the door. The method may include determining that the door is not closing with a predetermined acceptable closing speed, and using the determined door closing speed to determine that a motor assist is needed to complete closing of the door.

When the door moves in the direction of closing and the electric motor/generator is not powered, the electric motor/generator may act as a generator and generated power is stored. When the door moves in the direction of opening, the electric motor/generator is not powered, and the electric motor/generator may act as a generator and generated power is stored.

The method may comprise causing the electric motor/generator to be powered by the stored electrical energy generated by the electric motor/generator to vary the closing speed of the door.

The method may include storing energy in a spring as the door moves in the direction of opening and using the stored spring energy to move the door in the direction of closing. The electric motor/generator may be powered exclusively by stored electrical energy generated by the electric motor/generator. The electric motor/generator may be caused to be powered by the stored electrical energy generated by the electric motor/generator by applying a voltage to the motor.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

In FIG. 1, the door is in an open position.

DESCRIPTION OF THE EMBODIMENT(S)

Figure 1:
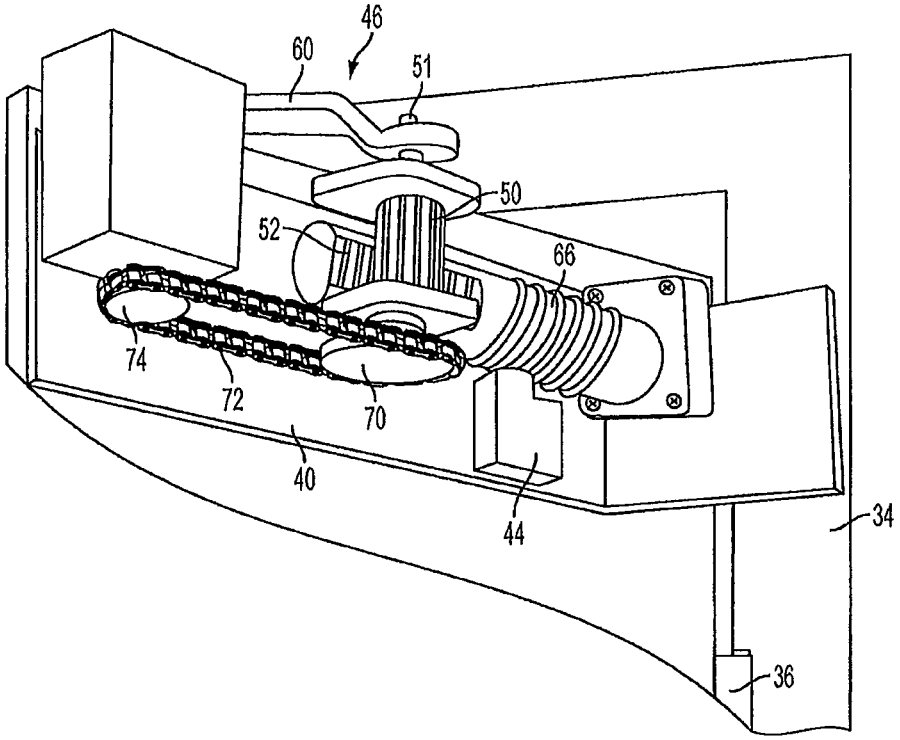
FIG. 1 is a perspective view of an installed, automatic, motor-assisted door closer according to one embodiment.

In describing the embodiment(s) of the present invention, reference will be made herein to FIGS. 1-14 of the drawings in which like numerals refer to like features of the invention. Other embodiments having different structures and operation do not depart from the scope of the present disclosure.

Certain terminology is used herein for convenience only and is not to be taken as a limitation on the embodiments described. For example, words such as "top", "bottom", "upper," "lower," "left," "right," "horizontal," "vertical," "upward," and "downward" merely describe the configuration shown in the figures. Indeed, the referenced components may be oriented in any direction and the terminology, therefore, should be understood as encompassing such variations unless specified otherwise.

As used herein, the term "open position" for a door means a door position other than a closed position, including any position between the closed position and a fully open position as limited only by structure around the door frame, which can be up to 180° from the closed position.

The present invention is directed to a door closer with an electric motor-assisted closing feature, provided by a motor/generator. Embodiments disclosed herein provide a regenerative oil-less door closer with the latch boost closing feature. The door closer may have a spring that provides almost all of the closing force. The embodiment described does not include a cylinder with hydraulic fluid, however, one could be provided. A motor may provide additional force to assist the door in latching to overcome external forces. When the door is closing as the result of the force of the spring, the motor may be backdriven. The backdriving of the motor makes the motor into a generator, and the inefficiencies of the motor as well as electrical energy conversion may slow the closing speed of the door. The motion of the opening of the door may also drive the motor and cause the motor to generate power. Generated power may be stored in an energy storage element, such as a battery or capacitor.

As the door moves to close by the force of the spring, the motor may be driven to collect power, and a capacitor or battery may be charged, making the door closer regenerative. Metering of power generation may be performed with a varied resistance or through a regenerative braking circuit/algorithm. The varied generated current can be used to increase or decrease the energy converted to electricity, and accordingly controls the motor speed when the motor is acting as a generator, which controls the closing speed of the door in opposition to the spring. Inefficiencies of the motor also contribute to slowing door closing speed. Power that is left over or unused during the closing of the door may be captured and stored or converted to heat. When the latch boost is needed, voltage is injected or applied to the motor to drive the motor and cause the door to latch. In one embodiment, a position sensor such as a potentiometer or proximity switch determines the door position. A speed sensor such as a rotary encoder may also be used to determine the door position and closing speed. The sensor communicates with a control unit, which includes a processor and engages the motor when the latch boost force is needed.

Figure 2:
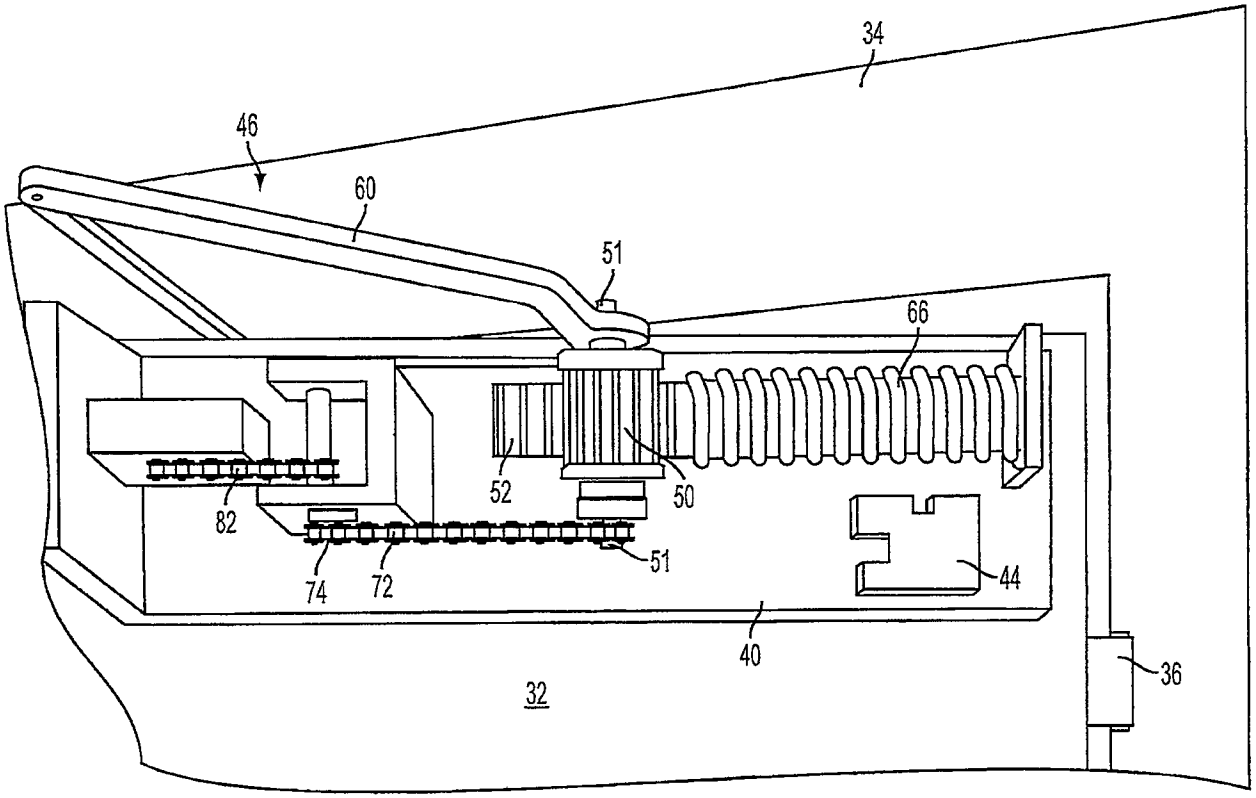
FIG. 2 is a perspective view of the door closer of FIG. 1 where the door is in a closed or nearly closed position and in the latch boost region.
Figure 3:
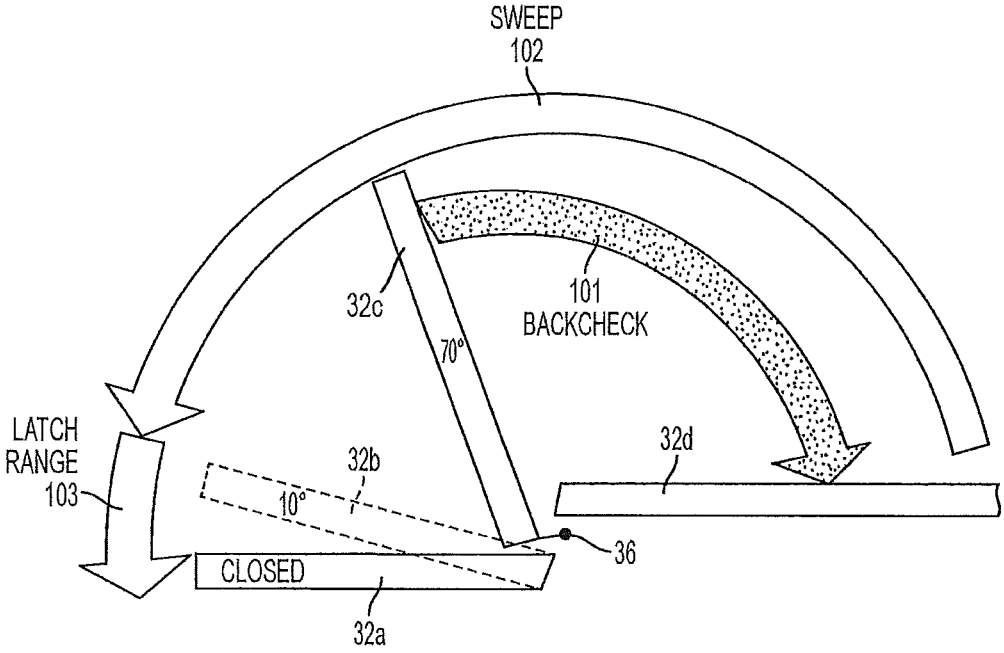
FIG. 3 is a schematic top plan view of the range of motion of the door.

Referring now to the drawings, an embodiment of a door closer is shown in FIG. 1, and is generally designated at 30. The door closer 30 is mounted to a door 32 that is mounted to a door frame 34 with hinges 36 for movement of the door 32 relative to the frame 34 between a closed position and an open position. For the purpose of this description, there is shown only the upper portion of the door 32 and the door frame 34 to which the door closer is mounted. The door 32 is of a conventional type and is pivotally mounted to the frame 34 by hinges 36 for movement from an open position, as shown in FIG. 1, to a nearly closed position in the "latch boost region", as shown in FIG. 2. A schematic top plan view of the range of motion of door 32 is shown in FIG. 3, wherein door 32 is shown pivoting on hinge 36 through several positions starting from closed position 32*a* to fully open position 32*d*. The door closer may be designed to provide a significant resistive force when the door is pushed open beyond a specific angle, for example, 60 to 70 degrees from closed. This high-force region of operation of the door is often referred to as the "back check" region, and the high force is intended to prevent the back of the door from hitting a wall or stop, possibly causing damage. When the door is moving from the closed position in the direction of opening, the back check range 101 extends from a door position 32*c* about 70 degrees from closed (0 degrees) to door position 32*d* about 180 degrees from closed. The degree of door opening is made or adjusted according to the uses of the individual door and user. During the door opening, the door closer may have an otherwise conventional mechanical (e.g., spring) or hydraulic potential energy storage to provide a bias to swing the door closed. When the door then moves from whatever maximum open position is achieved toward the direction of closing, the door then moves through the closing sweep range 102 to the latch range 103 at door position 32*b*. The latch boost region is the door position near the closed position at which the door movement slows, and assistance beyond that provided by the potential energy spring or hydraulic storage may be needed to complete closing of the door. This may be the result of the latch contacting the strike plate, or air flow pushing against the door in the opening direction. The latch boost region at which additional closing force is needed may be, for example, in about the last 5 to 10 degrees of closing of the door.

Continuing with FIGS. 1 and 2, the door closer 30 includes a back plate 40, a motor 42, a control unit 44, and an operator arm assembly 46 for operably coupling the door closer 30 to the door frame 34. The back plate 40 may be securely mounted to door face near the upper edge of the door 32 using mounting screws or other fasteners. The back plate 40 extends generally horizontally with respect to the door frame 34. The motor 42 and control unit 44 are mounted to the back plate 40. Also as shown in FIG. 4, the operator arm assembly 46 is mounted to a pinion 50 that engages a rack 52.

Still referring to FIGS. 1 and 2, a cover (not shown) may be attached to the back plate 40 to surround and enclose the components of the door closer 30 that are within the limits of the back plate 40 to reduce dirt and dust contamination, and to provide a more aesthetically pleasing appearance. It is understood that although the back plate 40 is shown mounted to the door 32 with the operator arm assembly 46 mounted to the door frame, the back plate 30 could be mounted directly to the door frame 34, mounted to the opposite side of the door 32, mounted to the either side of the wall adjacent to the door frame 34, or concealed within the wall or door frame 34.

Figure 4:
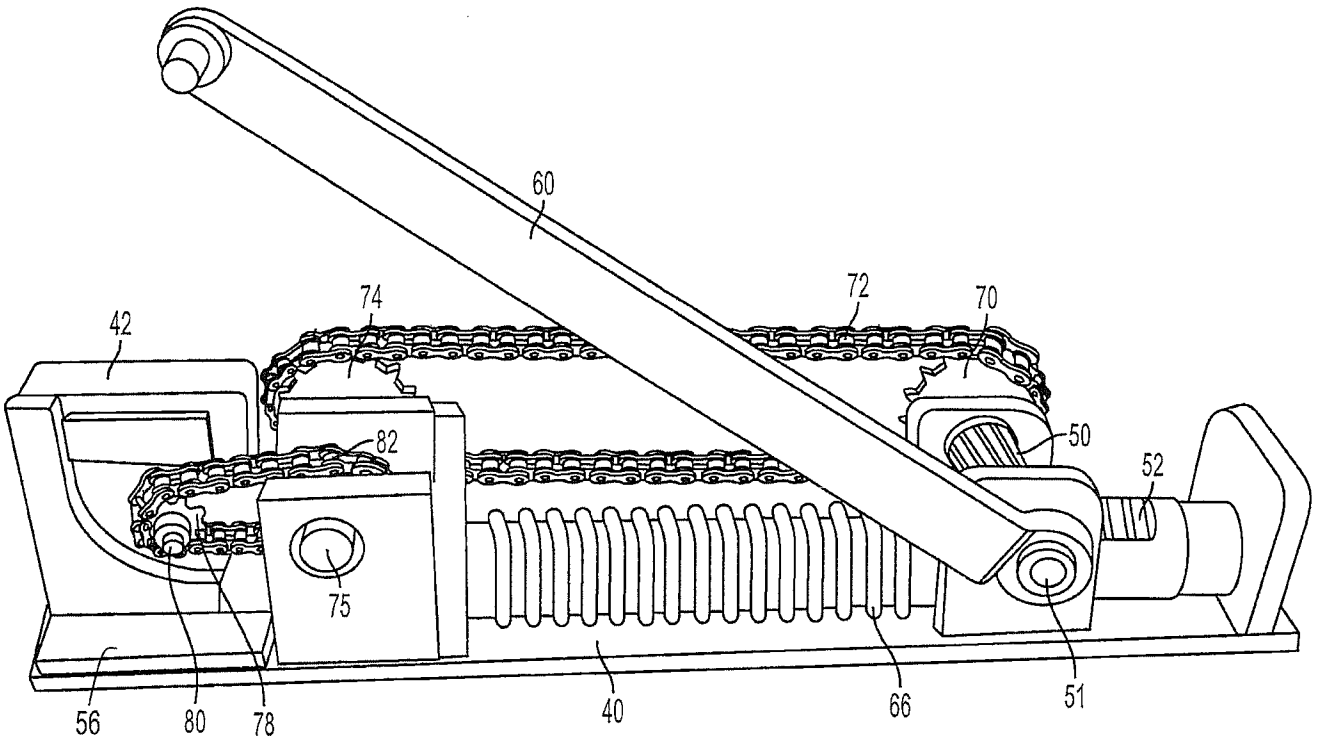
FIG. 4 is a top perspective view of an automatic, motor-assisted door closer according to another embodiment of the present invention.
Figure 5:
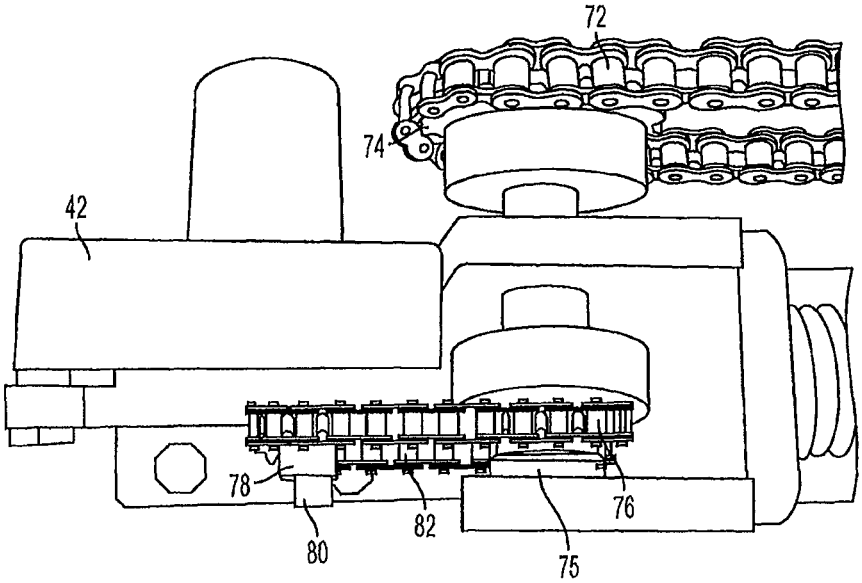
FIG. 5 is an enlarged elevation view of the door closer of FIG. 4 at the end of the closer with the electric motor.
Figure 6:
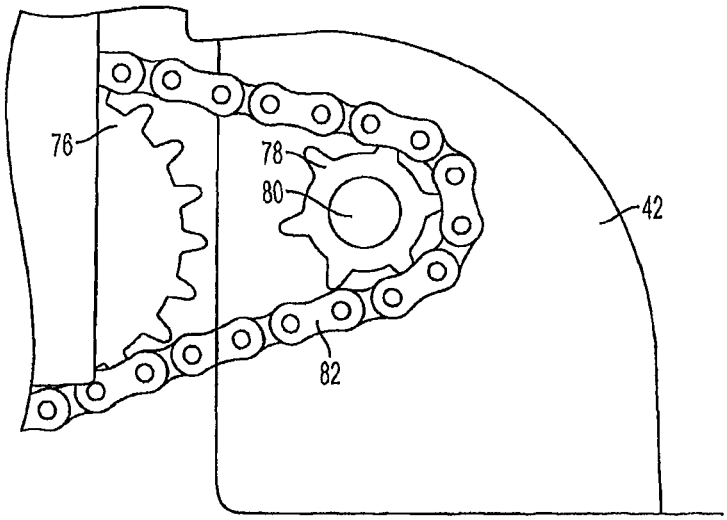
FIG. 6 is an enlarged top plan view at the electric motor of the door closer of FIG. 4.

Referring now to FIGS. 4-6, the motor 42 is an electric motor mounted to the back plate 40 with a mounting bracket 56. The motor may be a permanent magnet DC gearmotor, as shown in FIG. 5, and functions as a motor/generator. Any suitable brush or brushless motor/generator may be employed. The motor 42 when functioning in the electric motor mode applied voltage causes the drive shaft 80 to be driven in the direction that closes the door. When functioning in the generator mode, the motor drive shaft 80 may be backdriven by movement of the door to generate an output voltage and current. It will be understood by those skilled in the art that the electric motor/generator may be selected and sized according to the dimensions and weight of the hinged door 32, the force required to cause the door 32 to latch, and anticipated forces that may act against closing.

The control unit 44 (FIGS. 1 and 2) regulates the operation of the motor and thus regulates the latch boost feature. The control unit 44 is in communication with the motor, which is adapted to receive signals from the control unit 44. The control unit 34 will be further described below with reference to FIG. 6. The control unit 44 may be adjusted to generate signals that control the speed of the motor for controlling the speed of latching the door 32. The control unit may also include an LED to signal operation or various modes of operation. It is understood that although the control unit 44 is shown mounted to the back plate 40, the controller 44 could also be housed internally within the wall, a ceiling, or remotely, such as in a mechanical room, for example.

The control unit 44 is part of an overall control system which may include a door position sensor, such as a potentiometer or proximity sensor, optionally a speed and position sensor, such as a rotary encoder, and a potentiometer in electrical communication with the control unit 44 for allowing a user to selectively control the delivery of electrical energy to the motor and to control the closing speed of the door 32 by varying the resistance provided by the motor 42.

The operator arm assembly 46 includes a linkage arm 60 that is mounted on and rotated by vertical shaft 51 on which the pinion 50 is mounted. The pinion 50 engages the rack 52. The rack 52 is urged to move by force of a spring 66 against the mounting for shaft 51 and pinion 50. When the door 34 is open, the rack 52 may be at one end of its range of motion, and when the door 32 is closed, the rack 52 may be at the other end of its range of motion. When the rack 52 moves as a result of force from the spring 66, the pinion 50 and shaft 51 rotate, driving the linkage arm 60 to close the door. There is a sprocket 70 mounted to the side of the pinion 62 opposite the linkage arm 60, and the sprocket 70 engages a chain 72. When the rack moves as the result of force from the spring 66, the sprocket 70 drives the chain 72. At the other end of the chain 72 is another sprocket 74. This sprocket 74 is caused to turn by the chain 72, and turns an axle 75 that has another sprocket 76 (FIG. 5) in alignment with a sprocket 78 on the drive shaft 80 of the motor 42, and another chain 82 causes the motor sprocket 78 to rotate, which reflects a gear reduction because of a smaller sprocket diameter of motor sprocket 78. Through the chains 72, 82 and the rotation of the sprockets 70, 74, 76, 78, the motor 42 is operable to drive the pinion 50 on shaft 51 or be driven by them as the door 32 closes. In some embodiments, the motor may be driven by the pinion 50 as the door 32 opens. In some embodiments, linkages may be used instead of the chains.

In the embodiment shown, the pinion 62, in addition to engaging the rack 64 may optionally be utilized by an optical, magnetic, or mechanical rotary encoder (not shown in FIGS. 1-6), which continuously tracks the movement of the teeth of the pinion 62 or other rotating part. In one embodiment, LEDs may be mounted to the rotating part and are detected by a phototransistor light sensor. Whether or not the speed sensor is used, a position sensor such as a proximity switch or a Hall effect sensor device (which may also be used as part of an encoder) is employed, and may be mounted to be in close proximity to the pinion or an operator arm hub. Magnets may be disposed at the pinion or hub. Other position sensor means may be used. The output of the rotary encoder is connected to the control unit 44, which converts the rotary encoder signals to displacement and displacement rate values, thereby enabling a processor in the control unit 44 to determine the location and rate of displacement of the door.

In use, upon the initial movement of the door 32 being opened, the rotary encoder (if used) is activated. The encoder signals the control unit 44, which converts the input to functions of door position and speed of displacement. A potentiometer may be used to control the resistance of the motor 42, which in turn may be used to slow the door closing speed, although other features are also available to control closing speed. The potentiometer and microprocessor may regulate the speed of closing by setting the potentiometer and the microprocessor trying to keep that speed. Regenerative braking by using the motor in the generator mode may be employed. Desired closing speed may be programmed into the control unit 44, and the closer 30 may be self-adjusting by the control unit 44 controlling the resistance through the potentiometer with the input of position and speed from the encoder. The position sensor may be used to monitor the position of the door throughout parts or all of the full sweep from closed to open, and back to closed, but it is important that the position sensor be able to determine when additional closing force is needed, such as when the door reaches the latch range (32*b* in FIG. 3), in the region of about 0 to about 5-10 degrees from closing. As the door 32 approaches the closed position, entering the "latch boost region," or at any other region where resistance to closing is encountered, the control unit 44 can inject or apply voltage to the motor 42, which will apply the additional closing force to the door 32, and stop the motor when the door is closed. The determination of whether the door will need assistance to latch may be done in ways such as monitoring the speed of the door and determining when the door slows to a speed lower than a predetermined acceptable closing speed, activating the latch boost or motor assist at a certain region, monitoring the voltage output of the motor, and so forth. For example, a speed sensor can be used to determine whether the door has closed or not closed within a predetermined acceptable closing speed, for example about 10 to 45 degrees per second or less. As part of the self-adjusting capability of the closer 30, if there is additional resistance to closing, such as from a gust of wind, the reduction in door speed will be detected by the encoder or other speed monitoring device, communicated to the control unit 44, and additional voltage can be injected or applied to the motor 42 to cause the door 32 to close. If the position or speed sensor detects a more sudden or substantial force pushing the door open such a person opening the closing door, the control unit may be programmed to stop injecting or applying voltage to the motor 42.

The determination of whether the door will need assistance to latch may also be done by timing the operation and determining when the door has not closed within a predetermined acceptable closing time. The self-adjusting capability of the closer 30 activates by the controller if there is additional resistance or time to closing, such as from a gust of wind. The additional closing time will be detected by a timer or other time monitoring device or sensor, communicated to the control unit 44, and additional voltage can be injected or applied to the motor 42 to cause the door 32 to close. For example, a time sensor or timer can be used to determine whether the door has closed within a predetermined acceptable closing time, for example about 2 to 10 seconds or more.

A door position sensor with or without an encoder may be used. The position sensor may be used to monitor the position of the door throughout parts or all of the full sweep from closed to open, and back to closed, but it is important that the position sensor be able to determine when additional closing force is needed, such as when the door reaches the latch range (32*b* in FIG. 3), in the region of about 0 to about 5-10 degrees from closing. Such a sensor, which may not be able to be used to determine door speed, preferably an electro-magnetic detection device such as a reed switch, as shown, or a Hall effect sensor device, may be mounted to be in close proximity to the annular the operator arm hub. One or more magnets may be disposed at the hub, with one magnet positioned to be under the sensor when the door is closed; the position of the magnet may be altered to adjust to the door position. By sensing when the "closed" magnet is in proximity, the sensor indicates to the control unit the status of the door position as nearly closed, for example, at the latch range. The sensor is in electrical communication with the control unit by means of wires. The sensor may indicate the door position status by either sending signals or not sending signals to the control unit depending on the position of the door and magnet. The switch associated with the sensor may be designed as either normally open or normally closed, operating by sending a signal to the control unit when there is a change in the magnetic field from the normal position, i.e., when the sensor is actuated by a magnet, either (1) sending a signal when in the presence of a magnetic field and not sending a signal when not in the presence of a magnetic field, or (2) sending a signal when in the presence of a magnetic field and sending a signal when not in the presence of a magnetic field. It will be understood by one of ordinary skill in the art that other sensor and switch technologies may be used to indicate door position; other switches that could be used include microswitches, limit switches, proximity switches, optical sensors, and the like. When the control unit senses the "closed" magnet approaching, the control unit creates a latch boost condition by engaging the motor using voltage injection or application to the motor.

Figure 7:
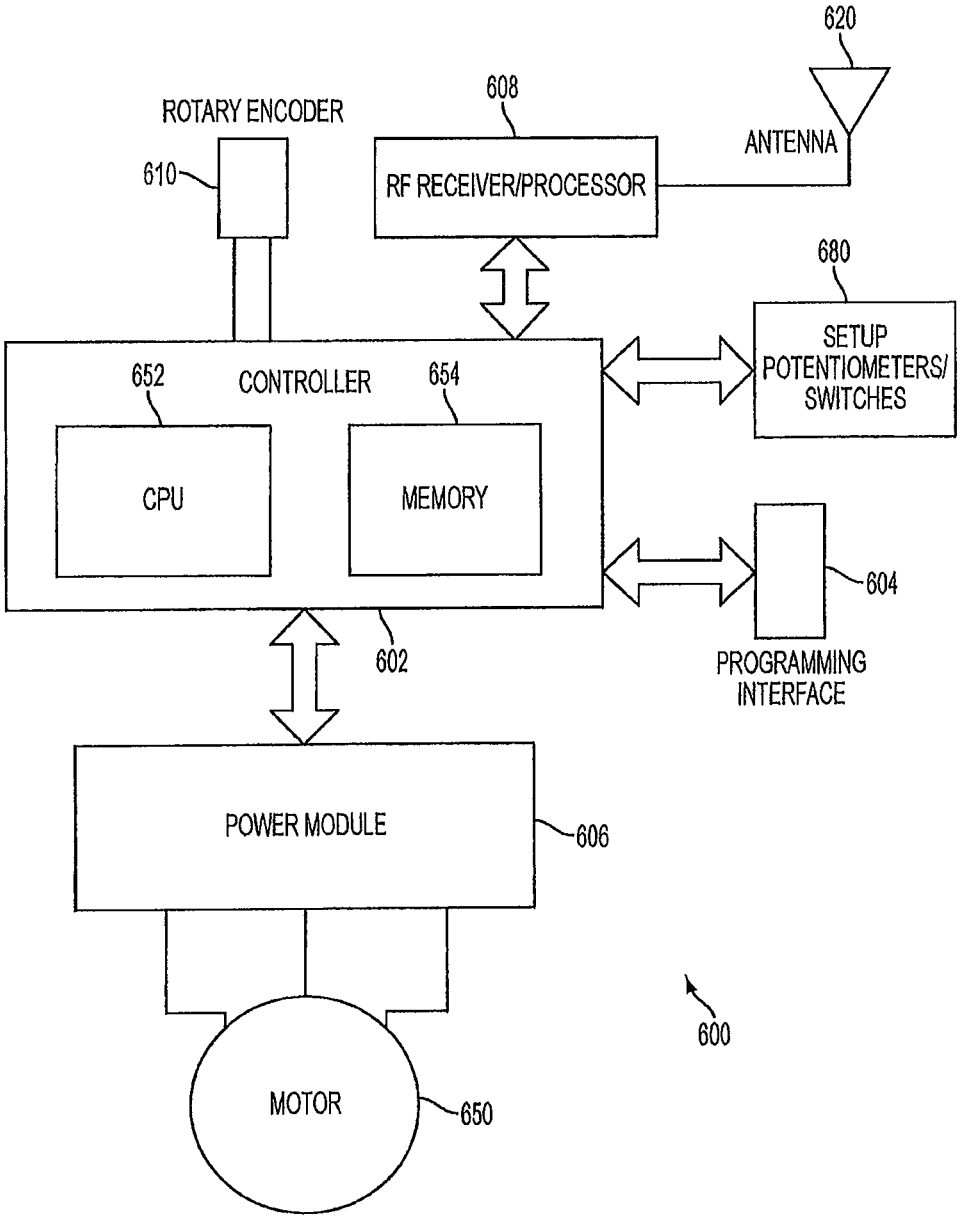
FIG. 7 is a schematic, block diagram of the electronic control system of a door closer according to example embodiments.

FIG. 7 shows a control system, 600, that can be used with a door closer according to embodiments of the present disclosure. Control system 600 includes a controller 602, an optional programming interface 604, and a power module 606, and also optionally, a radio frequency (RF) receiver/processor 608. In example embodiments, these components are part of control unit 44 illustrated in the previous figures. A position sensor, time sensor or rotary encoder 610 is connected to the control unit via wires and functionally interfaces with controller 602. If provision is made for remote control capability and an RF remote control is used, the RF receiver/processor 608 might also be connected to an antenna 620 via a wire or wires. The control system 600 serves to control the operation of the motor 650, which is the electric motor in a door closer according to example embodiments of the present disclosure.

In the example embodiments described herein, the control system includes components 680 to provide setup parameters to the controller. These components include potentiometers and dip switches. In one example, potentiometers are provided for closing force, obstruction sensitivity, motor delay, and the force by which the door is held closed against a doorframe. A dipswitch is provided to set the door closer for either left hand or right hand operation. Obstruction sensitivity determines how hard the door will push on an obstruction when opening before stopping. In some embodiments, these input components are monitored continuously to determine the operating parameters of the door closer. However, it is possible to design an embodiment where these settings are stored in a memory 654. In such an embodiment, the input components are read at start-up. It is also possible to design an embodiment where these parameters are put in the memory 654 through the programming interface 604 rather than input via connected components such as potentiometers or switches. The potentiometer for controlling resistance at the motor may be adjusted manually, may adapt automatically, or may be preset to control the door closing speed.

The power module 606 of FIG. 7 provides an interface between the controller or processor and the motor. In some embodiments, the power module 606 may be incorporated into the controller 602, or may not exist.

Controller 602 in this example embodiment includes a central processing unit (CPU) 652 and memory 654. Many different types of processing devices could be used to implement an embodiment of the present disclosure, including a processor, digital signal processor, or so-called, "embedded controller." Any of these devices could include memory along with a processing core such as a CPU, or could use external memory or a combination of internal and external memory. In the illustrated embodiment the memory stores firmware or computer program code for executing a process or method on the CPU or other processor to carry out an embodiment of the present disclosure. Such firmware or computer program code can be loaded into the control unit from an external computer system via programming interface 604. The process or method of an embodiment of the present disclosure could also be carried out by logic circuitry, a custom semiconductor device, or a combination of such a device or circuitry with firmware or software. As previously mentioned, in some embodiments the memory could also be used to store operating parameters.

An embodiment of an electric door closer may take the form of an entirely hardware embodiment, or an embodiment that uses software (including firmware, resident software, micro-code, etc.). Furthermore, an embodiment may take the form of a computer program product on a tangible computer-usable storage medium having computer-usable program code embodied in the medium. A memory device or memory portion of a processor as shown in FIG. 7 can form the medium. Computer program code or firmware to carry out an embodiment of the present disclosure could also reside on optical or magnetic storage media, especially while being transported or stored prior to or incident to the loading of the computer program code or firmware into a door closer. This computer program code or firmware can be loaded, as an example, through the programming interface 604 of FIG. 7 by connecting a computer system or external controller to the programming interface.

Figure 8:
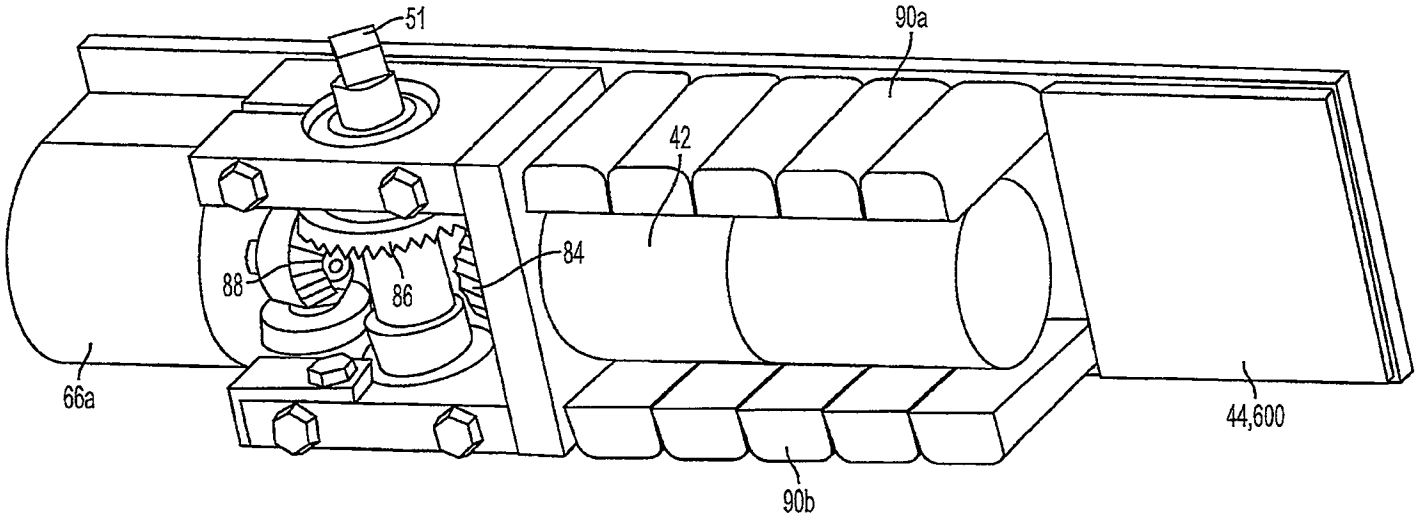
FIG. 8 is a perspective view of another embodiment of a door closer of the present invention.
Figure 9:
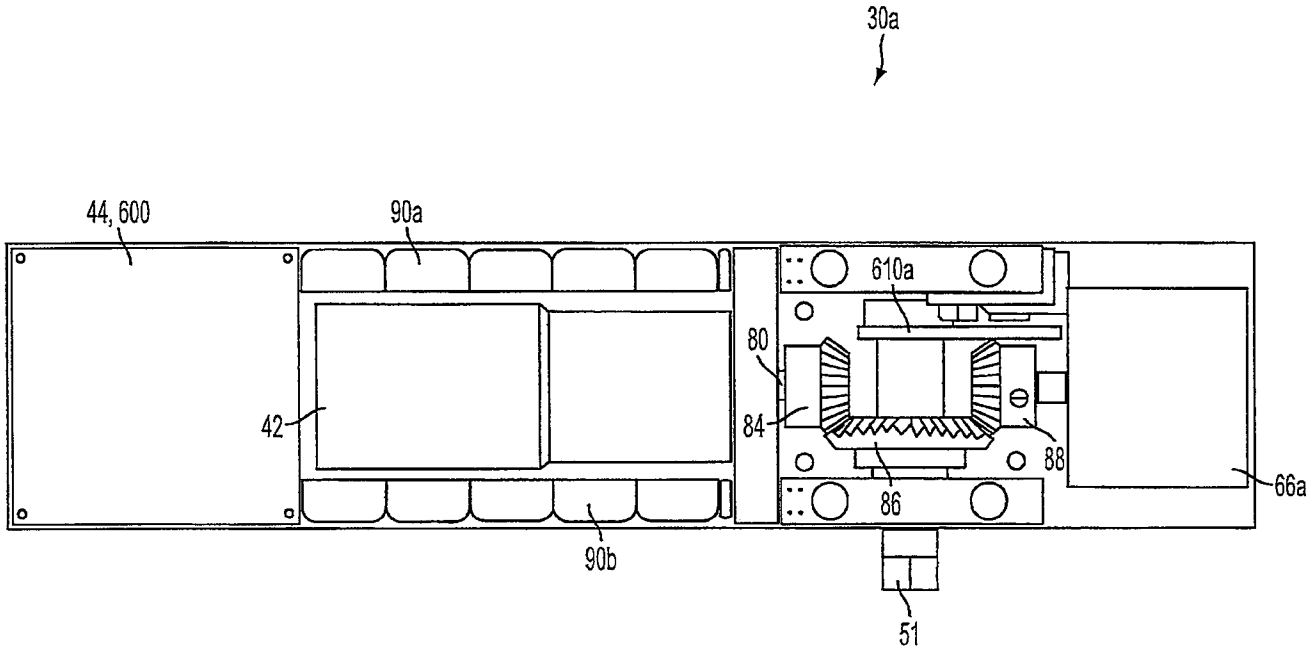
FIG. 9 is a top view of the door closer of FIG. 8.

Another embodiment of the door closer of the present invention is shown in FIGS. 8 and 9. Door closer 30*a* employs motor/generator 42 to drive horizontally extending shaft 80 on which bevel gear 84 is mounted. Bevel gear 84 engages bevel gear 86 mounted on vertically oriented shaft 51, which may be connected to drive the operator arm assembly (not shown). Bevel gear 86 in turn engages bevel gear 88, mounted on a horizontal shaft operatively connected to torsional spring 66*a*, which stores potential energy as the door is opened. Sensor 610 is operatively connected to shaft 51 and rotates therewith. When the motor/generator is in the generator mode, input motion from the operator arm connected to the door causes bevel gear 86 on shaft 51 to drive bevel gear 84 on motor drive shaft 80. When the motor/generator is in the motor mode, output motion of motor drive shaft 80 causes bevel gear 84 to drive bevel gear 86 on shaft 51 and the operator arm connected to the door.

In the embodiment of FIGS. 8 and 9, the door closer 30*a* includes electrical energy storage elements 90*a*, 90*b*, shown as a pair of rechargeable battery packs, electrically connected to the motor/generator 42. Alternatively, one or more capacitors may be used as the electrical energy storage element. The batteries 90*a*, 90*b* are configured to store electrical energy generated by the electric motor/generator as the door moves in the direction of opening or closing. The motor/generator controller 44, 600 is connected to the position, time or speed sensor 610*a* and motor/generator 42. The controller 44, 600 receives input from the position, time or speed sensor 610*a* and controls operation of the electric motor/generator 42. As spring 66*a* biases the door closed, the controller 44, 600 determines when a motor assist is needed to complete closing of the door, for example by the previously discussed position, time or speed sensing inputs and methods. The controller 44, 600 thereafter causes the electric motor/generator 42 to be powered by electrical energy generated by the electric motor/generator and stored in the electrical energy storage element to apply force to assist the door in closing to the closed position. The door closer may be configured to operate to power the motor in the assistance phase exclusively by electrical energy generated by the electric motor/generator 42 and stored in the electrical energy storage element 90*a*, 90*b*. There is no need to use any outside or other electrical energy source to power the motor in this manner, such as by AC or DC power outside of the door closer. In other words, the door closer does not have to be plugged in or connected to an outside power source, and is completely self-contained in providing its power needs for the motor during the assist phase, including the sensors. The electrical energy may be stored in the electrical energy storage element over more than one door opening and closing cycle, so that the energy used by the assist is not limited to that stored during the same opening/closing cycle.

Figure 10:
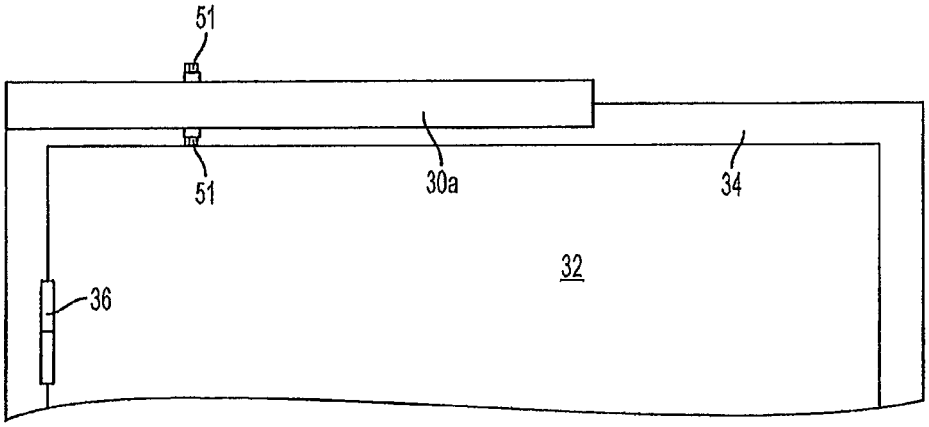
FIG. 10 is an elevational view of the door closer of the present invention mounted on the pull side of the door.
Figure 11:
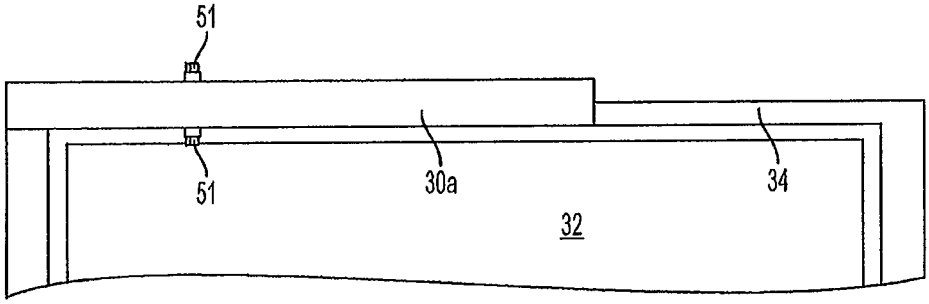
FIG. 11 is an elevational view of the door closer of the present invention mounted on the push side of the door.

As shown in FIGS. 10 and 11, the door closer 30*a* may be mounted on frame 34 on the pull side of the door 32, i.e., the side of the door in the direction of travel (FIG. 10), or on the push side of the door 32, i.e., the side of the door opposite the direction of travel (FIG. 11).

The voltage injection or application to the motor during the assist phase in the embodiment disclosed is accomplished by applying a continuous DC voltage to the motor from a battery or capacitor. The voltage level may be fixed relative to the position of the door; however, the voltage may be varied or changed depending on the exact position of the door with use of the aforediscussed position or speed sensors and appropriate programming of the controller. A pulsed voltage may also be applied to the motor to create the assist force, such as during latch boost.

Figure 12:
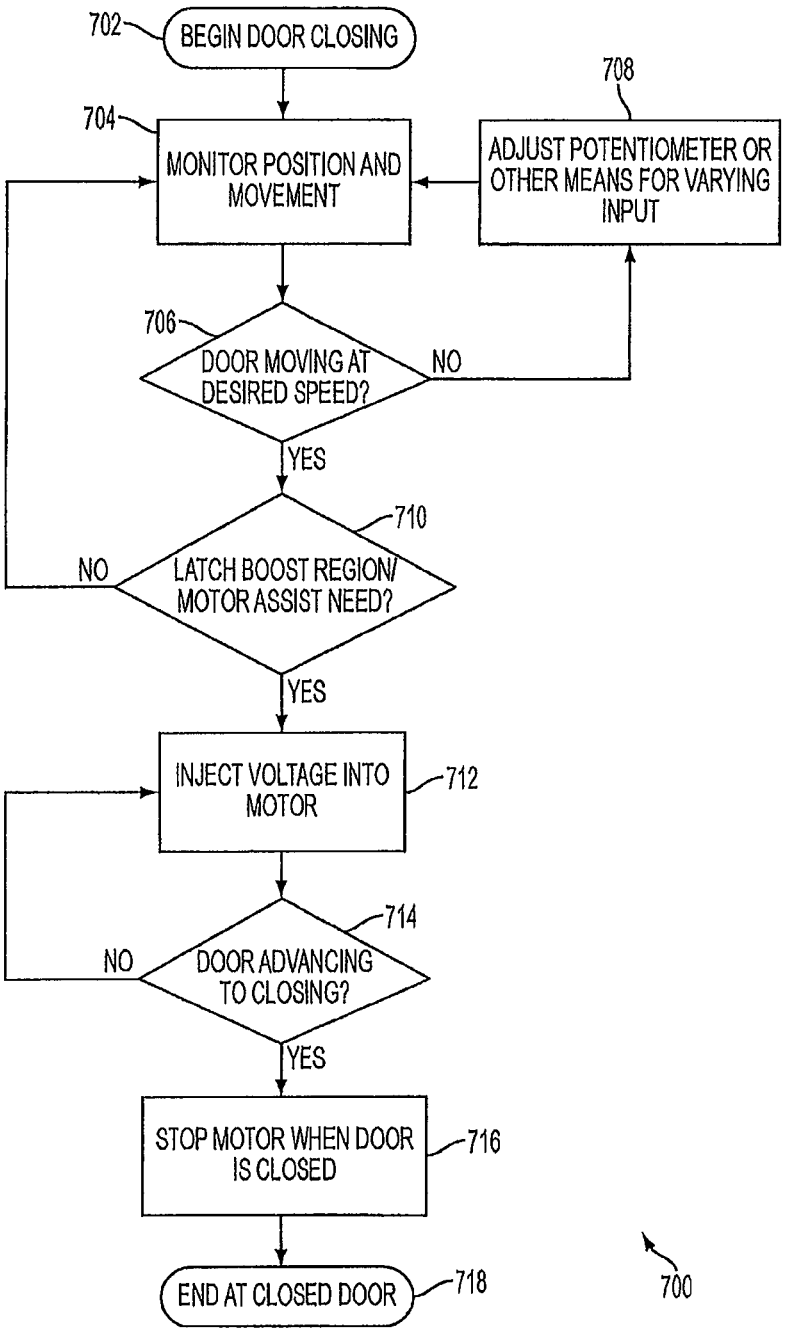
FIG. 12 is a flowchart that illustrates a portion of the method of operation of a door closer according to an example embodiment, the method being carried out by the electronic control system of FIG. 6.

FIG. 12 is a flowchart illustration of an embodiment of the latch boost/motor assist process 700 as executed by the controller of a door closer according to example embodiments of the present disclosure. Process 700 of FIG. 12 begins at block 702 with the door being open and beginning to move toward closed. At block 704, the door position and movement are being monitored to determine the door position, and, optionally, if the door is moving at the desired speed, which may also be related to the door position. If it is not moving at the desired speed at block 706, the potentiometer, or another means for varying input such as voltage, resistance, time vs. position, etc., may be adjusted to change the resistance at the motor at block 708. If the door closer is so equipped and programmed, the potentiometer adjustment may be directed by the control unit. If the door closer is not so equipped, this adjustment may be performed manually, or it may be preset. Whether or not the door is moving at the desired speed, the door will be monitored to identify whether it has moved into the latch boost region or otherwise has encounter conditions appropriate for motor assistance at block 710. If the control unit determines that the door has not moved into the latch boost region, the process will return to block 704. If the door has moved into the latch boost region or otherwise has encounter conditions appropriate for motor assistance, the control unit will cause voltage to be injected or applied to the motor, depending on the door speed and position, at block 712. If the control unit determines that the door is not advancing toward closed at block 714, the process will return to block 712 for additional injection or application of voltage to the motor, again depending on door speed and position. If the door is advancing to the closed position, the control unit will stop the motor at block 716 and the door will be closed at block 718.

The present invention may also be used to apply force from the motor/generator to resist the door opening beyond a predetermined angle of opening called the back check region 101 shown in FIG. 3. In this application, there is employed a sensor for determining angle of door opening, such as the position sensor previously described. The controller is connected to the door angle sensor and the motor/generator. The controller receives input from the door angle sensor and determines when the angle of door opening has come to the predetermined angle of opening, for example, 70 degrees from closing. The force applied may be sufficient to prevent the door from swinging as quickly as it would otherwise.

Figure 13A:
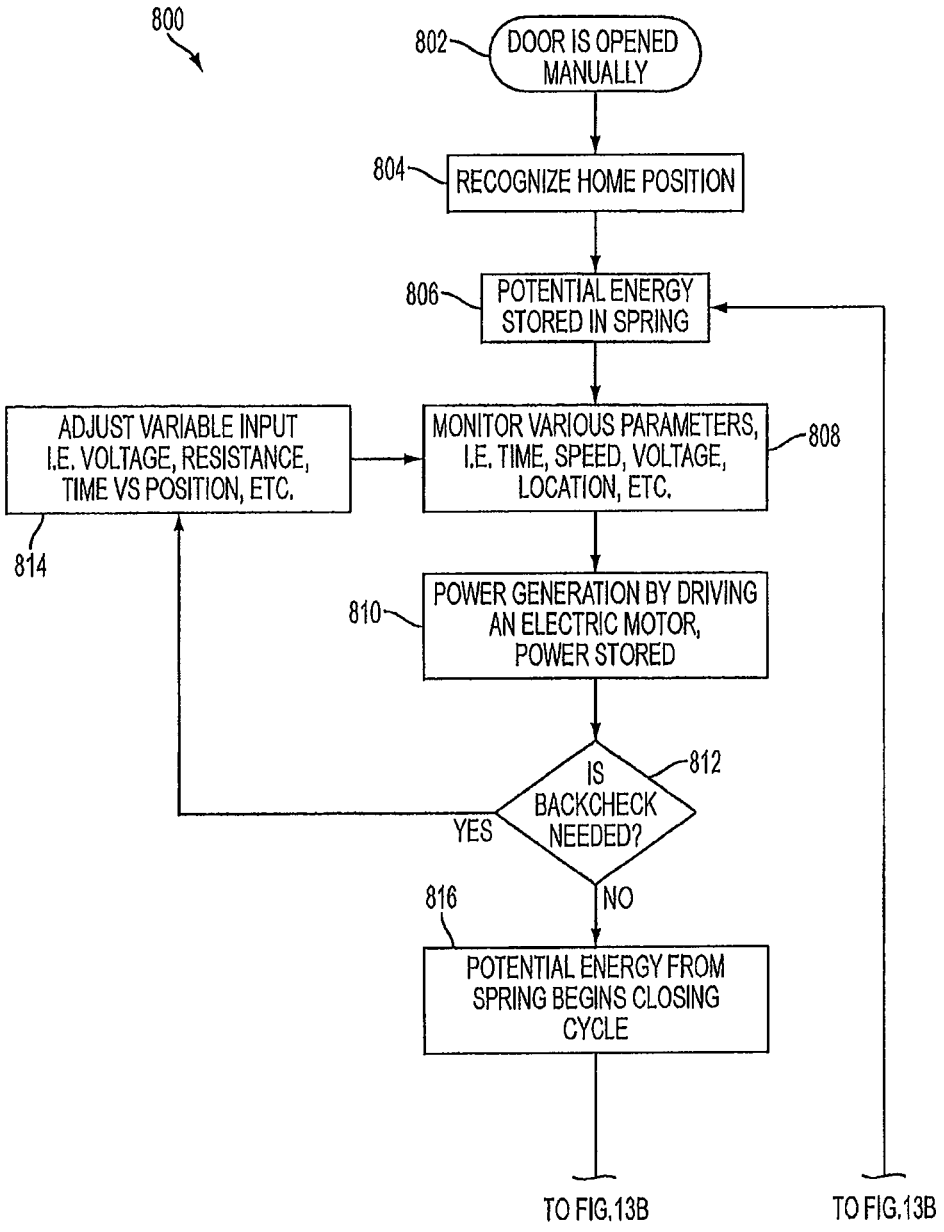
FIGS. 13A-B is a flowchart that illustrates a method of operation of a door closer according to another example embodiment, the method being carried out by the electronic control system of the present invention.
Figure 13B:
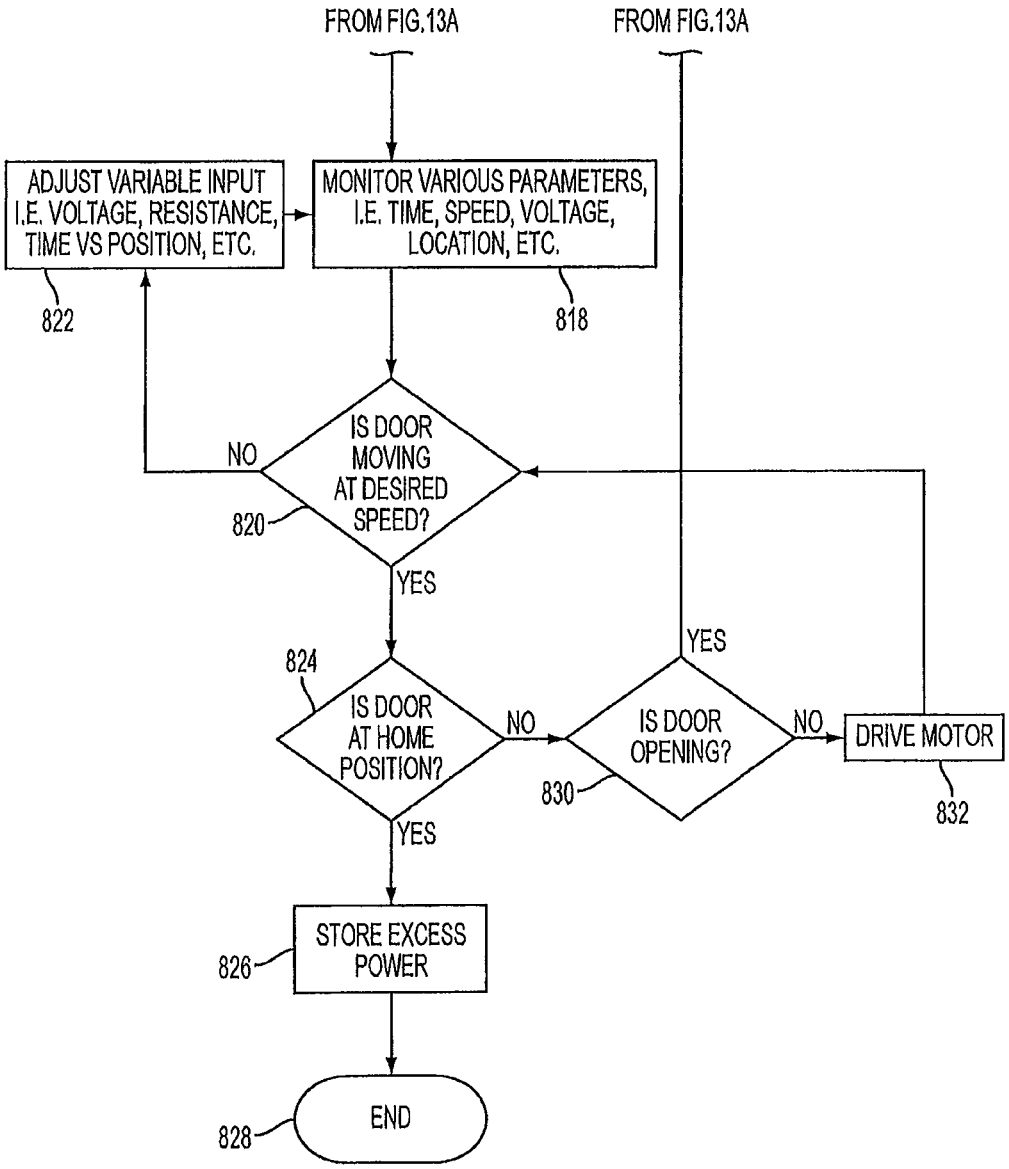

FIGS. 13A-B is a flowchart of another method of operation of an embodiment of a door closer showing process 800 as executed by the controller of a door closer according to example embodiments of the present disclosure. Beginning with block 802, in which the door is opened manually, the home 804 closed position of the door is recognized by a sensor. As the door is opened, in block 806 potential energy is used in the biasing spring which will be used to impart closing force to the door. Optionally, position, time and/or speed sensors monitor the door parameters in block 808 as the door is swung open, and power may be generated by placing the motor/generator in generator mode, and in block 810 the electrical energy may be stored in the rechargeable battery or capacitor. If in block 812 resistance to the door open position or speed is required in the back check region of door opening, the controller adjusts the variable parameters of the generator mode such as voltage, resistance, time versus position, and the like. After the door is opened to the desired extent, in block 816 the energy in the spring causes the door closing cycle to commence. During closing various parameters may be measured by way of position, time and/or speed in block 818. If speed is being optionally monitored and controlled, the door speed is measured and the controller determines in block 820 whether the door is closing at the proper speed. If it is not, in block 822 the controller adjusts the variable parameters of the generator mode such as voltage, resistance, time versus position, and the like until the proper speed is achieved. Subsequently, in block 824 once the door reaches the home or closed position, any excess power generated in the motor/generator generator phase has been stored in the rechargeable battery or capacitor for future use, and the particular door cycle ends 828. If the door is not in the home position, in block 830 the controller determines if the door is opening and if so the process returns to block 806. If the door is not in the home position and the door is not opening, in block 832 the controller determines that assistance is needed to close the door, and the motor/generator is turned to the motor phase and energy from the battery or capacitor is used to power the motor and force the door to close. At this point the process returns to block 820.

Figure 14:
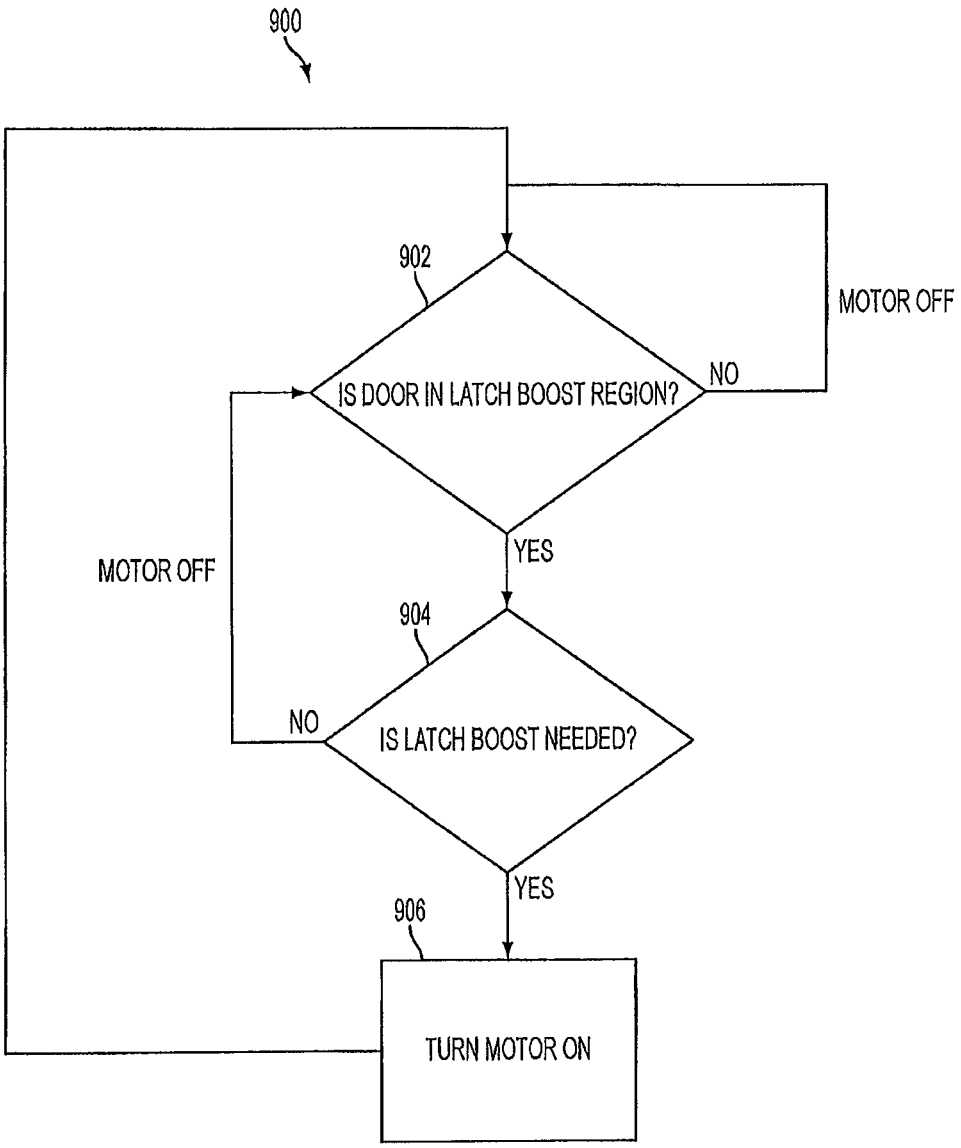
FIG. 14 is a flowchart that illustrates a method of operation of a door closer according to another example embodiment, the method being carried out by the electronic control system of the present invention.

A method of practicing the assistance boost aspect of the invention is shown in process 900 of the flowchart of FIG. 14, in which during the closing of the door, at block 902 the controller checks the position sensor to determine if the door is in the latch boost region. If the door is not in the latch boost region, the motor/generator is maintained in the motor off position, and may optionally be placed in the generator mode to apply regenerative braking to reduce the speed at which the door would otherwise be closing. If the door is in the latch boost region, at block 904 the controller determines whether assistance such as latch boost is needed to complete closing of the door. Such assistance may be determined by the position, time and/or speed sensors and methods described previously. If the sensor(s) and controller determine that assistance is needed, at block 906 the motor/generator is placed in motor mode and voltage is applied until the door closes completely.

The present invention therefore achieves one or more of the objects described above. The door closer is able to determine angle of door opening and apply force from a motor/generator to resist the door opening beyond a predetermined angle of opening. The door closer is able to determine when a motor assist is needed to complete closing of the door, and thereafter apply force to assist the door in closing to the closed position. The assistance determination is able to be made by door position, speed or time of closing. The electric motor/generator that provides the force assistance is powered by electrical energy generated exclusively by the electric motor/generator and stored in the electrical energy storage element. The door closer is able to provide more force upon closing during the latch boost or other assistance phases than just the spring from potential energy by using the generated power during the opening and/or closing cycle. The door closer is able to store electrical energy in the electrical energy storage element over multiple door opening and closing cycles, so that the energy used by the assist may be more than that stored during the same opening/closing cycle.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. Additionally, comparative, quantitative terms such as "less" or "greater" are intended to encompass the concept of equality, thus, "less" can mean not only "less" in the strictest mathematical sense, but also, "less than or equal to."

Although specific embodiments have been illustrated and described herein, those of ordinary skill in the art appreciate that any arrangement which are calculated to achieve the same purpose may be substituted for the specific embodiments shown and that the present disclosure has other applications in other environments. This application is intended to cover any adaptations or variations of the present disclosure. The following claims are in no way intended to limit the scope of the present disclosure to the specific embodiments described herein.

Thus, having described the invention, what is claimed is:

1. A door closer comprising:

an electric combination motor and generator configured to be operatively connected to a door movable between a closed position and an open position, the electric combination motor and generator having a drive shaft, wherein the drive shaft of the electric combination motor and generator rotates when the door moves in the direction of opening and in the direction of closing, the combination motor and generator being configured to apply force to move the door in the direction of closing in response to the rotation of the drive shaft of the electric combination motor and generator;

a speed sensor for determining closing speed of the door;

a timer for determining closing time of the door;

an electrical energy storage element connected to the combination motor and generator and configured to store electrical energy generated by the electric combination motor and generator as the door moves in the direction of opening or closing; and a combination motor and generator controller connected to the speed sensor, timer and combination motor and generator, the controller receiving input from the speed sensor and timer and controlling operation of the electric combination motor and generator, the controller determining whether the door is closing within a predetermined acceptable closing time or with a predetermined acceptable closing speed, and using determined door closing time or door closing speed as the door continues to move, determining as the door continues to move whether a motor assist is needed to complete closing of the door, and thereafter causing the electric combination motor and generator to be powered by electrical energy generated by the electric combination motor and generator and stored in the electrical energy storage element to apply force to assist the door in closing to the closed position.

2. The door closer of claim 1 further including a position sensor connected to the combination motor and generator controller for determining position of the door between the closed and open positions.

3. The door closer of claim 2 wherein the controller causes the electric combination motor and generator to apply force to assist the door in closing to the closed position based on the position sensor indicating that the door is in the vicinity of the closed position.

4. The door closer of claim 2 wherein the position sensor determines the position of the door only in the vicinity of the closed position.

5. The door closer of claim 2, wherein the door position sensor is a potentiometer.

6. The door closer of claim 2, wherein the door position sensor is a proximity switch.

7. The door closer of claim 6, wherein the proximity switch indicates if the door is in the closed position.

8. The door closer of claim 2, wherein the position sensor operates by sensing proximity of a magnet.

9. The door closer of claim 2, wherein the position sensor comprises a Hall effect device.

10. The door closer of claim 1, further comprising a spring adapted to bias the door toward the closed position.

11. The door closer of claim 1, wherein when the door moves in the direction of closing and the electric combination motor and generator is not powered, the electric combination motor and generator acts as a generator and generated power is stored in the electrical energy storage element.

12. The door closer of claim 11, wherein when the door moves in the direction of closing, the electric combination motor and generator acts as a brake on the rate of closing of the door.

13. The door closer of claim 1, wherein when the door moves in the direction of opening, the electric combination motor and generator is not powered, and the electric combination motor and generator acts as a generator and generated power is stored in the energy storage element.

14. The door closer of claim 13, wherein when a predetermined angle of door opening is reached, load on the combination motor and generator is increased to resist opening further.

15. The door closer of claim 13, wherein the load on the combination motor and generator is varied to resist the opening of the door to prevent the door from opening at an excessive rate.

16. The door closer of claim 15 wherein the door excessive rate is defined as moving above a predetermined speed.

17. The door closer of claim 15, wherein the door closer includes a spring adapted to bias the door toward the closed position, and wherein the door excessive rate consists of the door moving at a rate such that the kinetic energy of the door is greater than the energy that will be absorbed by the spring and losses as the door travels to a predetermined point.

18. The door closer of claim 1, further including a potentiometer that controls electrical resistance to control the rotation of the electric combination motor and generator and slow the closing speed of the door.

19. The door closer of claim 18, wherein the combination motor and generator controller includes a processor programmed to control the potentiometer or other means for varying load on the combination motor and generator to automatically adjust the closing speed of the door.

20. The door closer of claim 1, further including one or more motor control circuits operatively connected to the controller to permit the controller to control current in the combination motor and generator.

21. The door closer of claim 20, wherein the motor control circuits include high and low gates in a half H-bridge configuration.

22. The door closer of claim 20, wherein the motor control circuits include high and low gates in a full H-bridge configuration.

23. The door closer of claim 1 further including a memory operatively connected to the controller, wherein the controller receives data from the memory to determine that a motor assist is needed and control the electric combination motor and generator to exert a closing force on the door.

24. The door closer of claim 1 wherein the electric combination motor and generator is powered exclusively by electrical energy generated by the electric combination motor and generator and stored in the electrical energy storage element.

25. The door closer of claim 1, wherein the control of the combination motor and generator to exert a closing force on the door is accomplished by applying a voltage to the motor.

26. The door closer of claim 1, wherein the controller further detects as the door is closing a force pushing the door open and thereafter discontinues application of power to the electric combination motor and generator to close the door.

27. The door closer of claim 26, wherein the force pushing the door open is detected by the door speed sensor or by a door position sensor.

28. A method of operating a door closer using an electric combination motor and generator operatively connected to a door movable between a closed position and an open position, the method comprising:

storing electrical energy generated by the electric combination motor and generator as the door moves in the direction of opening or closing;

determining whether the door is closing within a predetermined acceptable closing time or with a predetermined acceptable closing speed as the door continues to move;

using determined door closing time or door closing speed, determining as the door continues to move that a motor assist is needed to complete closing of the door; and causing the electric combination motor and generator to be powered by the stored electrical energy generated by the electric combination motor and generator to apply force to assist the door in closing to the closed position.

29. The method of claim 28, further including determining the position of the door between the closed and open positions, and further using the determined door position to determine that a motor assist is needed to complete closing of the door.

30. The method of claim 28, further including determining the position of the door in the vicinity of the closed position, and further using the determined door position to determine that a motor assist is needed to complete closing of the door.

31. The method of claim 28, including detecting an increase in door closing time and determining that the door has not closed within a predetermined acceptable closing time, and using the determined door closing time to determine that a motor assist is needed to complete closing of the door.

32. The method of claim 28, including detecting a reduction in door closing speed and determining that the door is not closing with a predetermined acceptable closing speed, and using the determined door closing speed to determine that a motor assist is needed to complete closing of the door.

33. The method of claim 28, wherein when the door moves in the direction of closing and the electric combination motor and generator is not powered, the electric combination motor and generator acts as a generator and generated power is stored.

34. The method of claim 28, wherein when the door moves in the direction of opening, the electric combination motor and generator is not powered, and the electric combination motor and generator acts as a generator and generated power is stored.

35. The method of claim 28, further comprising causing the electric combination motor and generator to be powered by the stored electrical energy generated by the electric combination motor and generator to vary the closing speed of the door.

36. The method of claim 28, further including storing energy in a spring as the door moves in the direction of opening and using the stored spring energy to move the door in the direction of closing.

37. The method of claim 28, wherein the electric combination motor and generator is powered exclusively by stored electrical energy generated by the electric combination motor and generator.

38. The method of claim 28, wherein the electric combination motor and generator is caused to be powered by the stored electrical energy generated by the electric combination motor and generator is by applying a voltage to the motor.

39. The method of claim 28, further including as the door is closing detecting a force pushing the door open and thereafter discontinuing application of power to the electric combination motor and generator to close the door.

40. The method of claim 39, wherein the force pushing the door open is detected by a door position sensor.

41. The method of claim 39, wherein the force pushing the door open is detected by a door speed sensor.

* * * * *